US008036585B2

(12) United States Patent
Okamoto

(10) Patent No.: US 8,036,585 B2
(45) Date of Patent: Oct. 11, 2011

(54) LUBRICANT SUPPLYING UNIT, PROCESS UNIT INCORPORATING SAME, IMAGE FORMING APPARATUS INCORPORATING SAME, AND METHOD OF MANUFACTURING SAME

(75) Inventor: Keiji Okamoto, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 111 days.

(21) Appl. No.: 12/553,239

(22) Filed: Sep. 3, 2009

(65) Prior Publication Data

US 2010/0061779 A1 Mar. 11, 2010

(30) Foreign Application Priority Data

Sep. 10, 2008 (JP) ..... 2008-232414

(51) Int. Cl.
*G03G 21/00* (2006.01)

(52) U.S. Cl. ..... 399/346

(58) Field of Classification Search ..... 399/346; 430/126.2

See application file for complete search history.

(56) References Cited

U.S. PATENT DOCUMENTS

| | | | | |
|---|---|---|---|---|
| 6,160,977 | A * | 12/2000 | Takeichi et al. | 399/346 X |
| 7,305,203 | B2 * | 12/2007 | Sampe et al. | 399/346 X |
| 2005/0025520 | A1 * | 2/2005 | Murakami et al. | 399/346 X |
| 2007/0172273 | A1 * | 7/2007 | Harada et al. | 399/346 |
| 2007/0209877 | A1 | 9/2007 | Arai et al. | |
| 2008/0118285 | A1 * | 5/2008 | Karasawa | 399/346 |

FOREIGN PATENT DOCUMENTS

| | | | |
|---|---|---|---|
| JP | 2000-162938 | | 6/2000 |
| JP | 2000-181284 | | 6/2000 |
| JP | 3205159 | | 6/2001 |
| JP | 2001-183859 | * | 7/2001 |
| JP | 2006-343623 | | 12/2006 |
| JP | 2007-219506 | | 8/2007 |
| JP | 2007-298948 | | 11/2007 |
| JP | 4046311 | | 11/2007 |
| JP | 4248316 | | 1/2009 |

* cited by examiner

*Primary Examiner* — Sandra Brase

(74) *Attorney, Agent, or Firm* — Oblon, Spivak, McClelland, Maier & Neustadt, L.L.P.

(57) ABSTRACT

A lubricant supplying unit, which can be incorporated in a process unit for use in an image forming apparatus, includes a rotary lubricant supplying member to contact a surface of an image carrier to rotate with the image carrier, a lubricant having an opposed face disposed opposite the rotary lubricant supplying member and side faces, a lubricant holder to hold the lubricant, and a pressing member to press the lubricant toward the lubricant supplying member either directly or via an intermediate transfer member. The rotary lubricant supplying member rotating to scrape the lubricant to supply the scraped lubricant to the image carrier. The lubricant holder supporting at least the entire side face of the lubricant intersecting the opposed face of the lubricant in a cross-section of the lubricant and the lubricant holder in a direction perpendicular to an axial direction of the rotary lubricant supplying member.

15 Claims, 7 Drawing Sheets

LUBRICANT SUPPLYING UNIT, PROCESS UNIT INCORPORATING SAME, IMAGE FORMING APPARATUS INCORPORATING SAME, AND METHOD OF MANUFACTURING SAME

CROSS-REFERENCE TO RELATED APPLICATIONS

The present invention claims priority pursuant to 35 U.S.C. §119 from Japanese Patent Application No. 2008-232414, filed on Sep. 10, 2008 in the Japan Patent Office, which is hereby incorporated by reference herein in its entirety.

BACKGROUND OF THE INVENTION

1. Field of the Invention

Exemplary embodiments of the present invention generally relate to a lubricant supplying unit, a process unit incorporating the lubricant supplying unit, an image forming apparatus incorporating the lubricant supplying unit, and a method of manufacturing the lubricant supplying unit.

2. Discussion of the Related Art

Full-color image forming apparatuses for electrophotographic image forming, for example, copiers, printers, and facsimile machines, generally perform either a direct transfer operation or an indirect transfer operation. In the direct transfer operation, a toner image formed on an image carrier is transferred directly onto a recording medium that is conveyed along an outer circumferential surface of a sheet conveyance belt. By contrast, in the indirect transfer operation, a toner image is formed on an image carrier that contacts an intermediate transfer belt and is transferred onto an outer circumferential surface of the intermediate transfer belt by an electric field supplied by a transfer bias unit, and is then transferred onto a recording medium conveyed along the outer circumferential surface of the intermediate transfer belt.

After image transfer, residual toner remains on the surface of the image carrier and/or the surface of the intermediate transfer belt. So as not to adversely affect a subsequent image forming operation, a cleaning unit removes the residual toner from the surfaces of the image carrier and the intermediate transfer belt. Known cleaning units typically include a cleaning blade formed by an elastic material such as a rubber material so that the cleaning blade slidably contacts the surface of the image carrier or the intermediate transfer belt to remove the residual toner therefrom.

However, a cleaning member such as the above-described known cleaning blade and a known cleaning brush can wear out with time as they slidably contact the surface of the image carrier or the intermediate transfer belt. The wear of the cleaning blade and the cleaning brush can cause cracks in or deformation thereof, resulting in reduced cleaning ability. In addition, the surface of the image carrier can be worn out as well as due to such contact, thus shortening the life of the image carrier.

To eliminate the above-described wear of the cleaning member and the image carrier, friction resistance between the image carrier and the cleaning member is reduced by supplying lubricant to the surface of the image carrier.

FIG. 1 shows a commonly known lubricant supplying unit that supplies lubricant to the surface of the image carrier.

The lubricant supplying unit shown in FIG. 1 includes a solid lubricant 100, an image carrier 200, a brush roller 300 disposed between the solid lubricant 100 and the image carrier 200, and a spring 400.

The solid lubricant 100 includes a lubricating material such as metal salt of fatty acid and is formed in a stick shape. The brush roller 300 is held in contact with a surface of the image carrier 200 as the spring 400 presses the solid lubricant 100 against the brush roller 300.

The above-described known lubricant supplying unit rotates the brush roller 300 that is pressed against the solid lubricant 100 so as to slidably scrape the solid lubricant 100 and turn the solid lubricant 100 into powder lubricant. The powder lubricant scraped from the solid lubricant 100 adheres to brush fibers of the brush roller 300 and is supplied to the surface of the image carrier 200 as the brush roller 300 rotates.

In a slightly different arrangement shown in FIG. 2, a different known lubricant supplying unit can include a lubricant roller 500. In contract to the stick-shaped solid lubricant of the lubricant supplying unit described below, this known lubricant supplying unit causes the brush roller 300 to rotate and contact the lubricant roller 500 while in rotation, so that the brush roller 300 scrapes the lubricant roller 500 to supply the scraped powder lubricant to the surface of the image carrier 200. Thus, this known lubricant supplying unit employs a roller-shaped lubricant to make the entire circumferential surface a lubricant supplying face, thereby effectively consuming the lubricant.

However, in the related-art lubricant supplying unit shown in FIG. 1, as the brush roller 300 scrapes the solid lubricant 100, as the solid lubricant is consumed it acquires an arc-shaped recess as shown in FIG. 3, forming edge portions E that project sharply from the cut face of the solid lubricant 100. The sharply projecting edge portions E are weak and thus prone to collapse, causing lack or breakage of the solid lubricant 100. Entry of broken-off pieces of solid lubricant into the image forming unit(s) can cause failures related to development, charging, and/or cleaning, resulting in defective images.

One way to counteract the above-described problem is to give the solid lubricant 100 a width B1 greater than an outer diameter "d" of the brush roller 300 as shown in FIG. 4A. By so doing, as shown in FIG. 4B, side portions of widths B2 and B3 at both ends on the cut face of the solid lubricant 100 remain, which can reduce chances of collapse of the solid lubricant 100. However, in this case, an amount of lubricant left unconsumed may increase, which is uneconomical. Further, with such an approach a large space to mount the solid lubricant is required.

Further, as shown in FIG. 2, if lubricant can be formed in a roller shape, the lubricant can be consumed without breakage. However, it is difficult to form lubricant in a roller shape, and moreover, even after a roller-shaped lubricant is made, it is difficult to protect an entire circumferential surface of the roller-shaped lubricant from contamination. In addition, such a roller-shaped lubricant requires a driving mechanism to rotate the roller-shaped lubricant, which can lead to a complicated configuration and a concomitant cost increase.

SUMMARY OF THE INVENTION

Exemplary aspects of the present invention have been made in view of the above-described circumstances.

Exemplary aspects of the present invention provide a lubricant supplying unit that can include lubricant having a good lubricant supplying ability and preventing deficit thereof.

Other exemplary aspects of the present invention provide a process unit that can incorporate the above-described lubricant supplying unit.

Other exemplary aspects of the present invention provide an image forming apparatus that can incorporate the above-described lubricant supplying unit.

Other exemplary aspects of the present invention provide a method of manufacturing the above-described lubricant supplying unit.

In one exemplary embodiment, a lubricant supplying unit includes a rotary lubricant supplying member to contact a surface of an image carrier to rotate with the image carrier, a lubricant having an opposed face disposed opposite the rotary lubricant supplying member and a side face, a lubricant holder to hold the lubricant, and a pressing member to press the lubricant toward the rotary lubricant supplying member either directly or via an intermediate transfer member. The lubricant supplying member rotates to scrape the lubricant to supply the scraped lubricant to scrape the lubricant to supply the scraped lubricant to the image carrier. The lubricant holder supports at least the entire side face of the lubricant that intersects the opposed face of the lubricant disposed opposite the rotary lubricant supplying member in a cross-section of the lubricant and the lubricant holder in a direction perpendicular to an axial direction of the rotary lubricant supplying member.

The lubricant holder may include an opening facing the rotary lubricant supplying member and a recessed portion accommodating the lubricant therewithin. The recessed portion of the lubricant holder may include opposing side faces disposed opposite each other and a bottom face. The side faces of the recessed portion of the lubricant holder may support at least the entire side face of the lubricant in the cross-section of the lubricant and the lubricant holder in a direction perpendicular to the axial direction of the rotary lubricant supplying member.

A width between the side faces of the recessed portion of the lubricant holder may be substantially equal to a diameter of the rotary lubricant supplying member in the cross-section of the lubricant and the lubricant holder in a direction perpendicular to the axial direction of the rotary lubricant supplying member.

A radius of the bottom face of the recessed portion of the lubricant holder may have an arc-shaped recess substantially equal to a radius of the rotary lubricant supplying member and the bottom face of the lubricant has an arc-shaped projection to fit the bottom face of the recessed portion of the lubricant holder in the cross-section of the lubricant and the lubricant holder in a direction perpendicular to the axial direction of the rotary lubricant supplying member.

A depth of the recessed portion of the lubricant holder may be smaller than an outer diameter of the rotary lubricant supplying member.

The lubricant may be formed by injecting melted lubricant in the recessed portion of the lubricant holder, and solidifying the injected lubricant in the lubricant holder.

The lubricant holder may be formed as a heat-resistant member.

The heat-resistant member may be capable of withstanding temperatures of 140 degrees Celsius or greater.

The opposed face of the lubricant disposed opposite the rotary lubricant supplying member has an arc-shaped recess having a radius substantially equal to a radius of the rotary lubricant supplying member in the cross-section of the lubricant in a direction perpendicular to the axial direction of the rotary lubricant supplying member.

The lubricant may be formed in an arc-shaped recess by using a molding member.

The lubricant holder may be detachably attachable to the lubricant supplying unit.

The above-described lubricant supplying unit may be integrally mounted with an image carrier to carry a latent image on a surface thereof. The lubricant supplying unit and the image carrier may be disposed within a process unit removably installable in an image forming apparatus.

Further, in one exemplary embodiment, an image forming apparatus includes an image carrier to carry an electrostatic latent image on a surface thereof, a charging unit disposed facing the image carrier to uniformly charge the surface of the image carrier, an exposure unit to expose the surface of the image carrier to form the electrostatic latent image, a developing unit to supply toner to the electrostatic latent image formed on the surface of the image carrier to develop the electrostatic latent image into a visible image, a transfer unit to transfer the visible image formed on the surface of the image carrier onto a recording medium directly or via an image transfer member, a cleaning unit to remove residual toner remaining on the surface of the image carrier, and the above-described lubricant supplying unit.

Further, in one exemplary embodiment, a method of manufacturing the above-described lubricant supplying unit includes melting the lubricant, injecting the lubricant into the recessed portion of the lubricant holder, and solidifying the injected lubricant in the lubricant holder.

The above-described method of manufacturing the above-described lubricant supplying unit may further include forming the lubricant holder as a heat-resistant member.

The heat-resistant member may be capable of withstanding temperatures of 140 degrees Celsius or greater.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
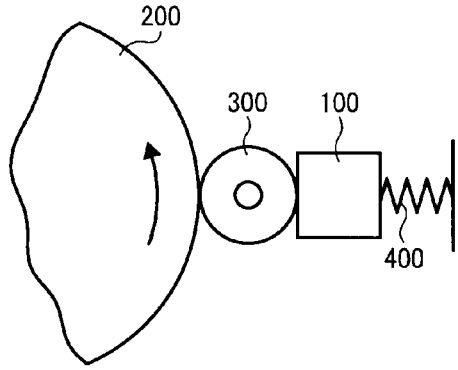
FIG. 1 BACKGROUND ART
FIG. 1 is a schematic configuration of a related-art lubricant supplying unit.
Figure 2:
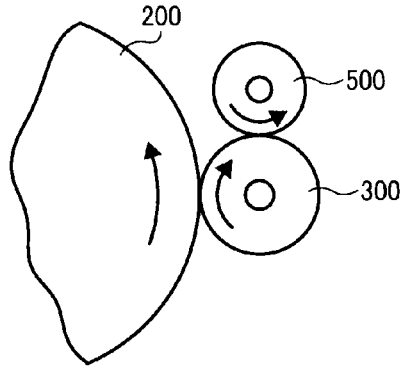
FIG. 2 BACKGROUND ART
FIG. 2 is a schematic configuration of a different related-art lubricant supplying unit.
Figure 3:
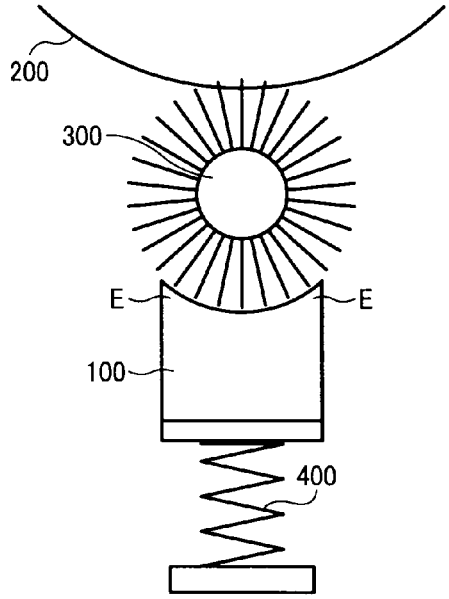
FIG. 3 BACKGROUND ART
FIG. 3 is a diagram for explaining an operation of the related-art lubricant supplying unit of FIG. 1.
Figure 4A:
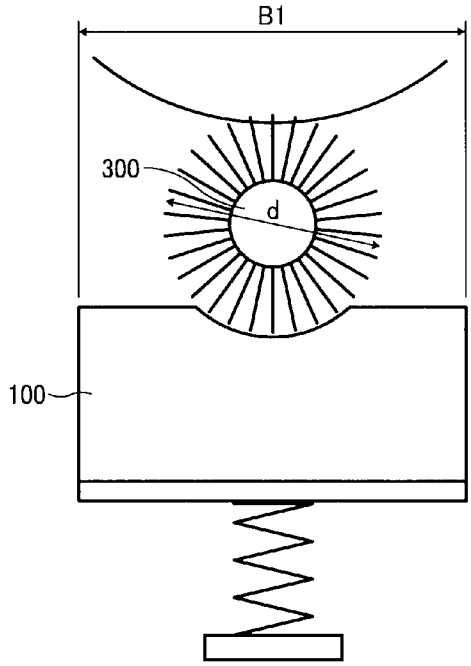
FIG. 4A BACKGROUND ART
FIG. 4A is a drawing for explaining of another operation of the related-art lubricant supplying unit different from FIG. 3.
Figure 4B:
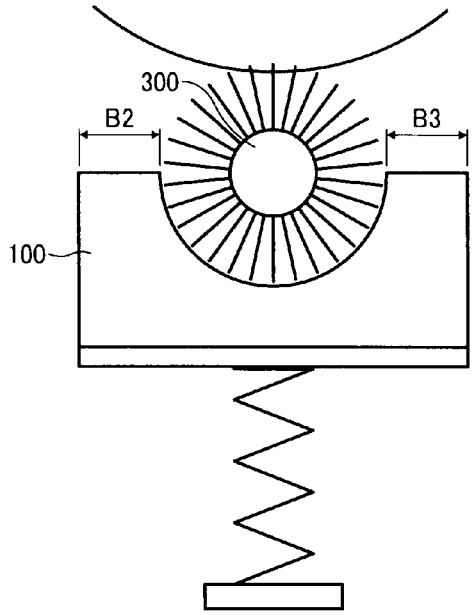
FIG. 4B BACKGROUND ART
FIG. 4B is a drawing for explaining of a different step of the operation shown in FIG. 4A.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, exemplary embodiments of the present invention are described.

Now, exemplary embodiments of the present invention are described in detail below with reference to the accompanying drawings.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus. For example, the technique of the present invention is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 5:
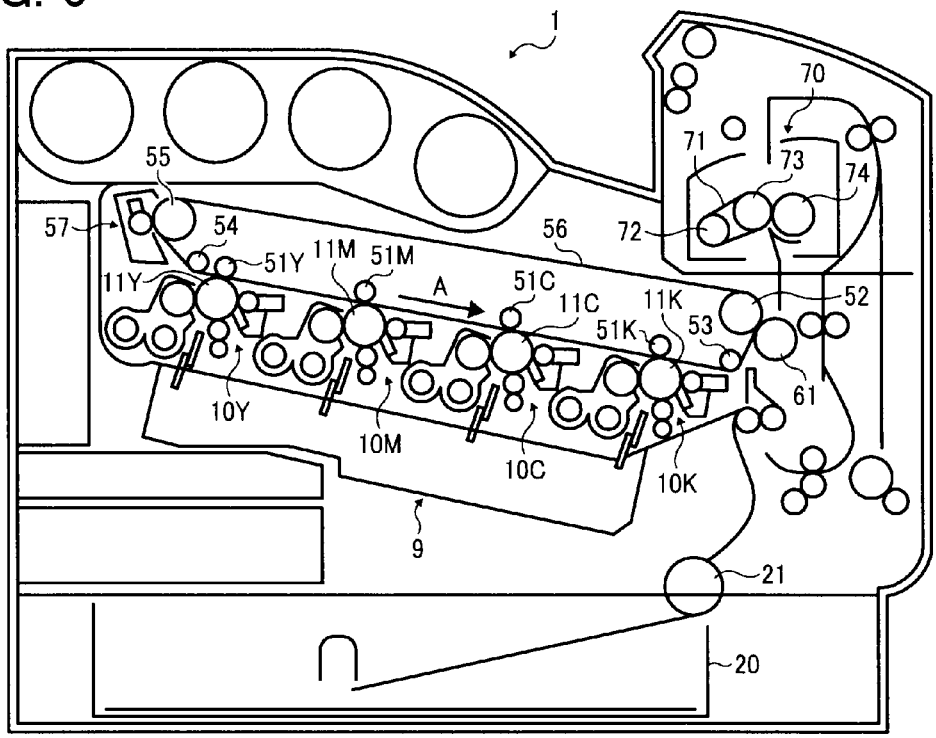
FIG. 5 is a schematic configuration of an image forming apparatus according to an exemplary embodiment of the present invention.

FIG. 5 illustrates a schematic configuration of the image forming apparatus 1 according to an exemplary embodiment of the present invention.

The image forming apparatus 1 can be any of a copier, a printer, a facsimile machine, a plotter, and a multifunction printer including at least one of copying, printing, scanning, plotter, and facsimile functions. In this non-limiting exemplary embodiment, the image forming apparatus 1 functions as a full-color printing machine for electrophotographically forming a toner image based on image data on a recording medium (e.g., a transfer sheet).

The toner image is formed with four single toner colors, which are yellow, cyan, magenta, and black. Reference symbols "Y", "C", "M", and "K" represent yellow color, cyan color, magenta color, and black color, respectively.

The image forming apparatus 1 of FIG. 5 corresponds to a printer, copier, facsimile machine, etc. and employs a tandem type indirect transfer system. In other words, the image forming apparatus 1 includes an intermediate transfer belt 56 that is disposed at a substantially center part thereof and four process units 10Y, 10M, 10C, and 10K.

The intermediate transfer belt 56 serves as an endless-shaped intermediate transfer member and includes a heat-resistant material such as polyimide and polyamide having a base body adjusted with medium-resistance. The intermediate transfer belt 56 is wound around four supporting rollers 52, 53, 54, and 55 and is rotationally conveyable in a direction indicated by arrow A in FIG. 5.

The four process units 10Y, 10M, 10C, and 10K for colors of yellow (Y), magenta (M), cyan (C), and black (K), respectively, are located above the intermediate transfer belt 56. The four process units 10Y, 10M, 10C, and 10K that serve as image forming units are disposed adjacent to each other along an outer surface of the intermediate transfer belt 56. Each of the four process units 10Y, 10M, 10C, and 10K is detachably attachable to the image forming apparatus 1.

Figure 6:
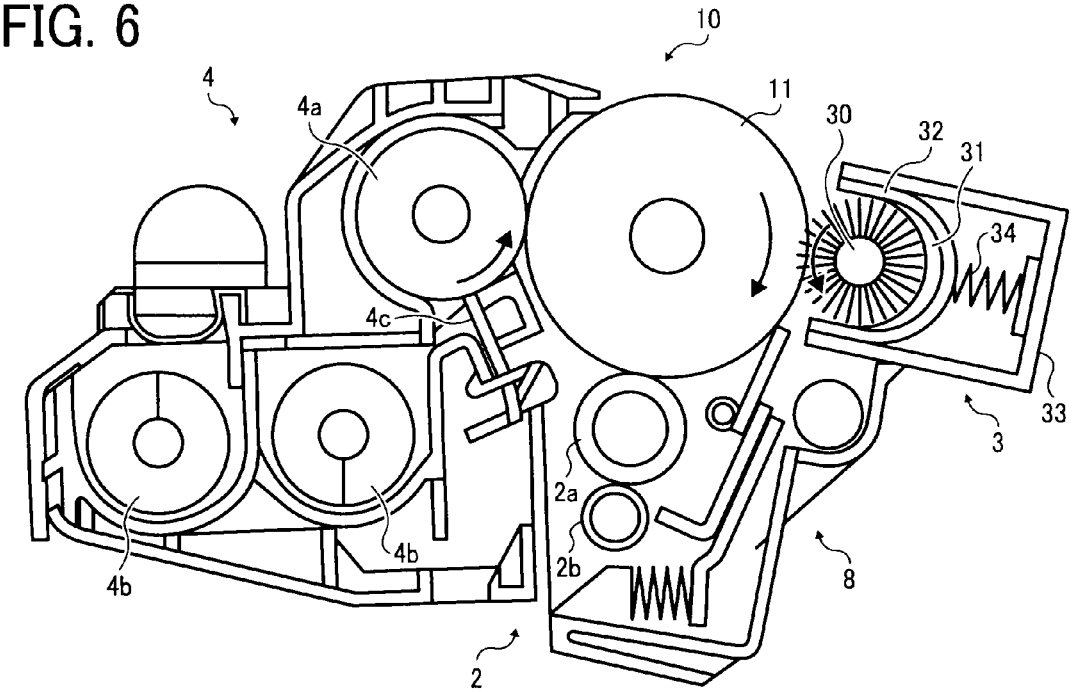
FIG. 6 is a schematic configuration of a process unit incorporated in the image forming apparatus of FIG. 5, the process unit incorporating a lubricant supplying unit according to an exemplary embodiment of the present invention.

FIG. 6 illustrates a schematic configuration of one of the process units 10Y, 10M, 10C, and 10K. Since the process units 10Y, 10M, 10C, and 10K for yellow (Y), magenta (M), cyan (C), and black (K) are configured in the same manner, components and units provided therein are denoted by common reference numerals without suffixes "Y", "M", "C", and "K" that are generally used to distinguish the colors.

The process unit 10 of FIG. 6 integrally includes a photoconductor 11 (illustrated as photoconductors 11Y, 11M, 11C, and 11K in FIG. 5), a charging unit 2, a lubricant supplying unit 3, a developing unit 4, and a cleaning unit 8.

The photoconductor 11 serves as an image carrier that carries an electrostatic latent image on a surface thereof.

The charging unit 2, the lubricant supplying unit 3, the developing unit 4, and the cleaning unit 8 are disposed around the photoconductor 11.

The charging unit 2 uniformly charges the surface of the photoconductor 11.

The developing unit 4 supplies toner and develops the electrostatic latent image formed on the surface of the photoconductor 11 into a visible toner image.

The lubricant supplying unit 3 supplies lubricant to the surface of the photoconductor 11.

The cleaning unit 8 cleans the surface of the photoconductor 11 after image transfer.

As shown in FIG. 5, the image forming apparatus 1 further includes an optical writing unit 9.

The optical writing unit 9 is located below the process units 10Y, 10M, 10C, and 10K to irradiate respective surfaces of the photoconductors 11Y, 11M, 11C, and 11K to optically write respective electrostatic latent images on the surfaces thereof according to image data.

The image forming apparatus 1 further includes primary transfer rollers 51Y, 51M, 51C, and 51K.

The primary transfer rollers 51Y, 51M, 51C, and 51K are disposed facing the photoconductors 11Y, 11M, 11C, and 11K, respectively, via the intermediate transfer belt 56. The primary transfer rollers 51Y, 51M, 51C, and 51K serve as primary transfer member to primarily transfer the toner images formed on the photoconductors 11Y, 11M, 11C, and 11K onto the intermediate transfer belt 56. The primary transfer rollers 51Y, 51M, 51C, and 51K are connected to a power supply, not illustrated, so that a given amount of voltage can be applied thereto.

The supporting roller 52 that supports the intermediate transfer belt 56 is disposed facing a secondary transfer roller 61 via the intermediate transfer belt 56.

The secondary transfer roller 61 serves as a secondary transfer member and is pressed against the intermediate transfer belt 56, which forms a secondary nip portion where a composite toner image formed on the intermediate transfer belt 56 is transferred onto a recording medium. The secondary transfer roller 61 is connected to a power supply, not illustrated, so that a given amount of voltage can be applied thereto.

The image forming apparatus 1 further includes an intermediate transfer belt cleaning unit 57.

The intermediate transfer belt cleaning unit 57 is located facing the supporting roller 55 via the intermediate transfer belt 56 to clean the surface of the intermediate transfer belt 56 after second image transfer.

The image forming apparatus 1 further includes a fixing unit 70 above the secondary nip portion formed between the supporting roller 52 and the secondary transfer roller 61.

The fixing unit 70 fixes the composite toner image formed on the recording medium firmly to the recording medium. The fixing unit 70 includes a fixing belt 71, a heat roller 72, a fixing roller 73, and a pressure roller 74.

The fixing belt 71 is an endless belt member spanned around the heat roller 72 that includes a halogen heater therein and the fixing roller 73. The pressure roller 74 is held in press contact with the fixing roller 73 via the fixing belt 71.

The image forming apparatus 1 further includes a sheet feed unit 20 and a pickup roller 21 at a lower part thereof.

The sheet feed unit 20 accommodates recording media and feeds the recording media one by one with the pickup roller 21 toward the secondary transfer nip portion.

Next, a detailed description is given of the image forming apparatus 1 in reference to FIG. 6.

The photoconductor 11 is an organic photoconductive element and includes a surface protection layer. Example materials of the surface protection layer of the photoconductor 11 include general-purpose resins such as polycarbonate (PC).

The charging unit 2 includes a charging roller 2*a* and a charging roller cleaning member 2*b*.

The charging roller 2*a* serves as a charging member and includes a conductive metallic core and a medium-resistance elastic layer covering the conductive metallic core. The charging roller 2*a* is connected to a power supply, not illustrated, so that a given amount of voltage can be applied thereto.

The charging roller 2*a* of the charging unit 2 is disposed facing the photoconductor 11 across a small gap. The small gap is formed, for example, by spacers each with a given constant thickness contacting a non-image forming area of both ends of the charging roller 2*a*.

The charging roller cleaning member 2*b* is disposed in contact with a surface of the charging roller 2*a* to clean the charging roller 2*a*.

The developing unit 4 includes a development sleeve 4*a*, two screws 4*b*, and a doctor blade 4*c*.

The development sleeve 4*a* is disposed facing the photoconductor 11 and includes a magnetic generating unit therein.

The two screws 4*b* are disposed below the development sleeve 4*a* to mix and agitate toner supplied from a toner bottle, not shown, together with developer and scoop the toner to the development sleeve 4*a*.

The doctor blade 4*c* regulates the developer including toner particles scooped by the development sleeve 4*a* and magnetic carrier particles to form a developer layer having a given thickness. The developer with a regulated thickness is carried on the development sleeve 4*a*.

The surface of development sleeve 4*a* moves in a same direction as the surface of the photoconductor 11 and conveys the developer, thereby supplying the toner particles to the electrostatic latent image formed on the surface of the photoconductor 11.

The image forming apparatus 1 shown in FIG. 5 and the process unit 10 shown in FIG. 6 have configurations employing the developing unit 4 using two-component developer. However, the present invention is not limited to the two-component developer but is also applicable to an image forming apparatus and a process unit employing a developing unit using one-component developer.

The lubricant supplying unit 3 includes a brush roller 30, a driver unit, not shown, a solid lubricant 31, a lubricant holder 32, a case 33, and a pressing member 34.

The brush roller 30 is disposed in contact with the photoconductor 11.

The driver unit rotates the brush roller 30.

The lubricant holder 32 holds and supports the solid lubricant 31.

The case 33 contains the lubricant holder 32.

The pressing member 34 is provided to the case 33 and presses the lubricant holder 32 toward the brush roller 30.

This exemplary embodiment employs the brush roller 30 as a rotary lubricant supplying member or a lubricant supplying roller to supply lubricant. However, the present invention is also applicable to a sponge roller, non-woven fabric roller, or the like as a rotary lubricant supplying member.

The lubricant holder 32 is contained in the case 33 to be moved slidably close to or away from the brush roller 30. Further, the lubricant holder 32 is detachably attachable to the case 33, and thus is also detachably attachable to the lubricant supplying unit 3.

The pressing member 34 corresponds to a spring member such as a leaf spring, a compression spring, or the like. Particularly, as shown in FIG. 6, a compression spring is preferably employed. The pressing member 34 presses the lubricant holder 32 so that the solid lubricant 31 can contact the brush roller 30.

The brush fibers of the brush roller 30 preferably have a thickness of 3 deniers to 8 deniers and a density of 20,000 fibers per square inch to 100,000 fibers per square inch. Thin and weak brush fibers can easily collapse when the brush roller 30 contacts the surface of the photoconductor 11. By contrast, when the brush fibers of the brush roller 30 are too thick, the density thereof is reduced. When the density of the brush fibers of the brush roller 30 is too low, the lubricant cannot be evenly applied since the number of brush fibers contacting the surface of the photoconductor 11 is reduced. By contrast, when the density of the brush fibers of the brush roller 30 is too high, a gap between the brush fibers of the brush roller 30 is reduced, thereby reducing the amount of the powder lubricant scraped from the lubricant and attached to the brush fibers and causing a shortage in the application amount of the lubricant. Accordingly, the brush roller 30 according to an exemplary embodiment of the present invention has the above-described thickness of brush fibers that cannot collapse easily and the above-described density of brush fibers that can supply an even amount of lubricant effectively.

In an exemplary embodiment, as for the solid lubricant 31, a dry solid hydrophobic lubricant can be used. The solid lubricant 31 may be formed of a material including a stearate group such as zinc stearate, barium stearate, lead stearate, iron stearate, nickel stearate, cobalt stearate, copper stearate, strontium stearate, calcium stearate, cadmium stearate, and magnesium stearate. In addition, materials including a similar fatty acid group such as zinc oleate, manganese oleate, iron oleate, cobalt oleate, lead oleate, magnesium oleate, copper oleate, zinc palmitate, cobalt palmitate, copper palmitate, magnesium palmitate, aluminum palmitate, and calcium palmitate can be used. Further, fatty acids and metal salts of fatty acids such as lead caprylate, lead caproate, zinc linolenate, cobalt linolenate, calcium linolenate, and cadmium lycolinolenate, and waxes such as candelilla wax, carnauba wax, rice wax, haze wax, jojoba oil, bees wax, and lanolin can be used.

Next, a description is given of a detailed configuration of the lubricant holder 32 according to an exemplary embodiment of the present invention.

Figure 7:
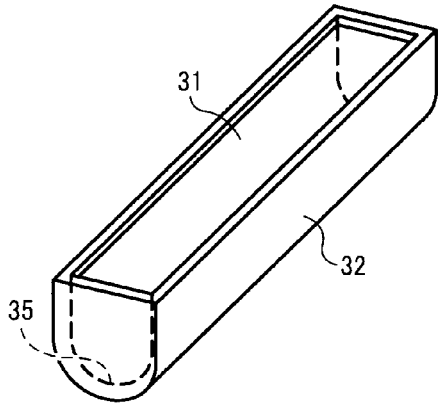
FIG. 7 is a perspective view of a lubricant holder incorporated in the process unit of FIG. 6 for supporting a solid lubricant.
Figure 8:
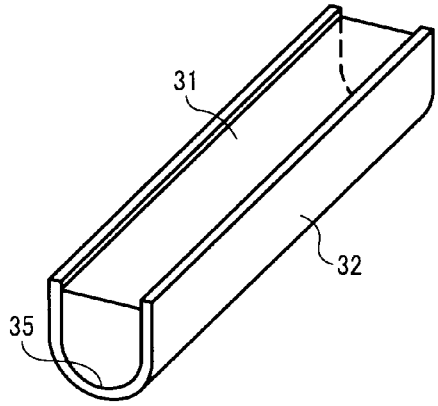
FIG. 8 is a perspective view of a lubricant holder having a different structure from that shown in FIG. 7.

FIG. 7 is a perspective view of the lubricant holder 32 that supports the solid lubricant 31. The lubricant holder 32 is formed to extend in an axial direction of the photoconductor 11. The lubricant holder 32 includes a recessed portion 35 to accommodate the solid lubricant 31 therein. Further, as shown in FIG. 8, the recessed portion 35 of the lubricant holder 32 can be formed to open at both ends in a longitudinal direction of the lubricant holder 32 as well as a side face that faces the brush roller 30.

Figure 9:
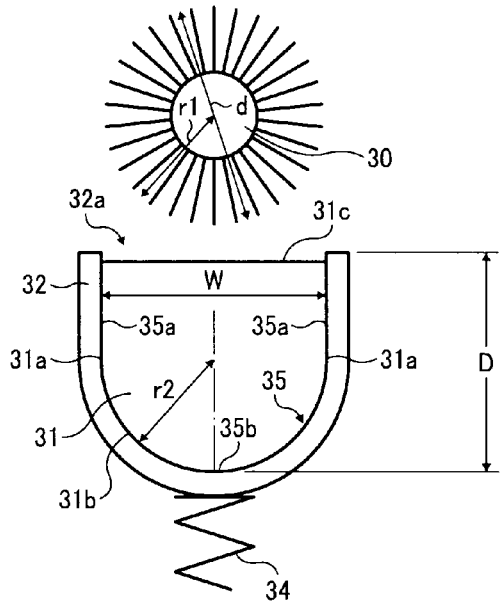
FIG. 9 is a cross-sectional view of the solid lubricant and the lubricant holder of FIGS. 7 and 8.

FIG. 9 is a cross-sectional view of the solid lubricant 31 and the lubricant holder 32, cut in a direction perpendicular to a longitudinal direction of or axial direction of the solid lubricant 31 and the lubricant holder 32. In other words, FIG. 9 is a cross-section viewed from one end of the solid lubricant 31 and the lubricant holder 32 when the solid lubricant 31 and the lubricant holder 32 are cut in a direction perpendicular to a longitudinal direction of or axial direction of the brush roller 30.

As shown in FIG. 9, the cross-section of the lubricant holder 32 is U-shaped with round corners and an opening 32*a* thereof faces the brush roller 30. That is, the recessed portion 35 of the lubricant holder 32 is defined by side faces 35*a* facing each other and a bottom face 35*b* having an arc-shaped recess.

A width W between the side faces 35*a* and 35*a* of the recessed portion 35 in FIG. 9 is substantially equal to an outer diameter "d" of the brush roller 30 in the cross-section of the solid lubricant 31 and the lubricant holder 32 in a direction perpendicular to the axial direction of the brush roller 30. Further, a radius r2 of the bottom face 35*b* of the recessed portion 35 of the lubricant holder 32 has the arc-shaped recess substantially equal to a radius r1 of the brush roller 30. Further, a depth D of the recessed portion 35 of the lubricant holder 32 is smaller than the outer diameter "d" of the brush roller 30.

The solid lubricant 31 has a shape fitting to an inner face of the recessed portion 35 of the lubricant holder 32. Specifically, the solid lubricant 31 includes side faces 31*a* disposed facing each other in a flat shape, a bottom face 31*b* having an arc-shaped projection, and an upper face 31*c*. The side faces 31*a* and the bottom face 31*b* of the solid lubricant 31 are supported by the side faces 35*a* and 35*a* and the bottom face 35*b* of the recessed portion 35 of the lubricant holder 32. In other words, the lubricant holder 32 is formed such that the side faces 35*a* and the bottom face 35*b* of the recessed portion 35 of the lubricant holder 32 support the side faces 31*a* and the bottom face 31*b* intersecting the upper face 31*c* that is disposed opposite the brush roller 30. The upper face 31*c* of the solid lubricant 31 disposed opposite the brush roller 30 has a flat surface.

Figure 10:
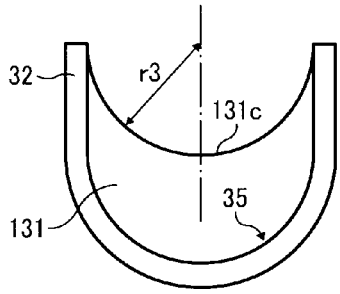
FIG. 10 is a cross-sectional view of a solid lubricant and a lubricant holder having a structure modified based on those shown in FIG. 9.

FIG. 10 illustrates a cross-sectional view of the lubricant holder 32 holding a solid lubricant 131 that is modified based on the solid lubricant 31.

The solid lubricant 131 includes an upper face 131*c* disposed opposite the brush roller 30. The upper face 131*c* is formed in an arc-shaped recess. A radius r3 of the upper face 31*c* having the arc-shaped recess has a substantially same distance as the radius r1 (see FIG. 9) of the brush roller 30. Other elements and shapes of the solid lubricant 131 are same as those of the solid lubricant 31 of FIG. 9, and therefore details thereof are omitted here.

Figure 11:
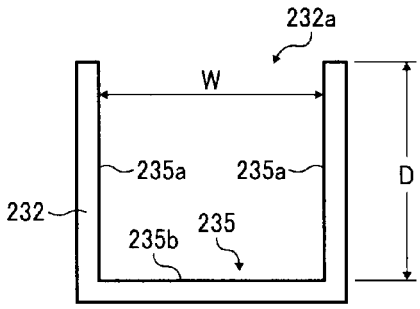
FIG. 11 is a cross-sectional view of a lubricant holder having a structure modified based on those shown in FIG. 9.

FIG. 11 illustrates a cross-sectional view of a lubricant holder 232 that is modified based on the lubricant holder 32.

The cross-section of the lubricant holder 232 shown in FIG. 11 is U-shaped with all corners in straight angles and an opening 232*a* thereof faces the brush roller 30. That is, a recessed portion 235 of the lubricant holder 232 is defined by side faces 235*a* and a bottom face 235*b*. The side faces 235*a* are flat-shape and face each other, and the bottom face 235*b* has a flat-shaped recess.

Other elements such as the width W and the depth D of the lubricant holder 232 are same as those of the lubricant holder 32 shown in FIG. 7 through FIG. 9, and therefore details thereof are omitted here.

Further, the cross-sectional shape of the lubricant holder 32 can be modified to any shape other than the U-shape with round corners and the U-shape with all corners in straight angles as described above.

The present invention provides the solid lubricant 31 that is formed by injecting molten lubricant into the recessed portion 35 of the lubricant holder 32 and solidifying the injected molten lubricant in the recessed portion 35. Specifically, the lubricant holder 32 is used as a mold to form the solid lubricant 31. Therefore, a separate mold to form the solid lubricant 31 is not needed. Further, a process to move the solid lubricant 31 from the separate mold to the lubricant holder 32 can be skipped, which can also avoid occurrence of damage to the solid lubricant 31 ad/or chips from the solid lubricant 31 that may be caused when moving the solid lubricant 31. Thus, use of the lubricant holder 32 as a mold to form the solid lubricant 31 can reduce manufacturing costs and production processes and enhance yield of lubricant.

Further, when using the lubricant holder 32 as a mold for forming the solid lubricant 31, the lubricant holder 32 needs to include a heat-resistant material. For example, the lubricant holder 32 can withstand temperatures of 140 degrees Celsius or greater, preferably. The temperature is a melting point of zinc stearate that is widely used as and included in the solid lubricant 31.

Figure 12:
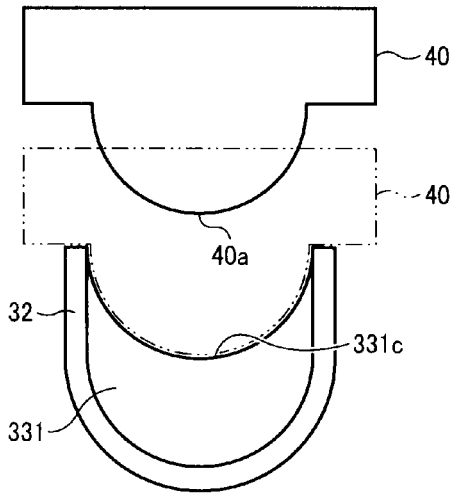
FIG. 12 is a drawing for explaining of forming a solid lubricant by using a mold.

Further, a mold 40 as shown in FIG. 12 can be used to form a solid lubricant 331 by solidifying molten lubricant. The mold 40 in FIG. 12 includes an arc-shaped projecting portion 40*a* to form the upper face 331*c* with the arc-shaped recess shown in FIG. 10.

The upper face 331*c* of the solid lubricant 331 can also be formed in a flat-shaped surface and then cut to form an arc-shaped recess. However, the cutting process increases the number of processes and the cut part of the solid lubricant 331 is discarded.

By contrast, when forming the solid lubricant 331 by moving the mold 40 to press the solid lubricant 331 as shown in FIG. 12, the number of production processes may not increase and any part of the solid lubricant 331 cannot be discarded. Consequently, the mold 40 enables production of the solid lubricant 331 in a desired shape easily and inexpensively.

In FIG. 12, the lubricant holder 332 is used as a mold to form and hold the lower part of the solid lubricant 331. However, a separate mold can be used to form and hold the lower part of the solid lubricant 331.

Figure 13:
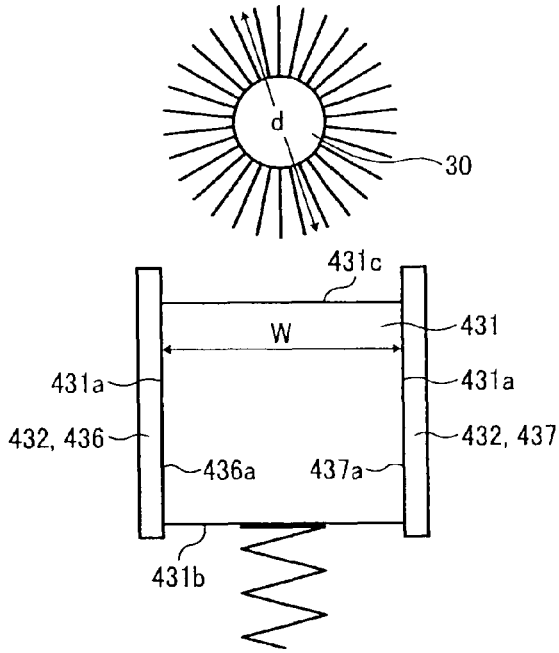
FIG. 13 is a cross-sectional view of a lubricant holder and a lubricant holder having a structure of another example based on those shown in FIG. 9.

FIG. 13 illustrates a cross-sectional view of a lubricant holder 432 according to another example based on the lubricant holder 32 of FIG. 9. In other words, FIG. 13 is a cross-section viewed from one end of the solid lubricant 431 and the lubricant holder 432 when the solid lubricant 431 and the lubricant holder 432 are cut in a direction perpendicular to a longitudinal direction of or axial direction of the brush roller 30.

The lubricant holder 432 of FIG. 13 includes a pair of planar members including planar members 436 and 437 to hold the solid lubricant 431. The planar member 436 includes an inner face 436*a* and the planar member 437 includes an inner face 437*a*.

The solid lubricant 431 includes side faces 431*a*, a bottom face 431*b*, and an upper face 431*c*.

The lubricant holder 432 is formed such that the inner faces 436*a* and 437*a* of the planar members 436 and 437 support the side faces 431*a* intersecting the upper face 431*c* that faces the brush roller 30. Further, a width W between the side faces 436*a* and 437*a* of the planar members 436 and 437 is substantially equal to the outer diameter "d" of the brush roller 30. Further, the pair of planar members including the planar members 436 and 437 can be connected integrally between the near side and the far side of FIG. 13.

Next, descriptions are give of working and effects of the lubricant supplying unit 3 according to the present invention, in reference to FIGS. 14 through 18.

Figure 14:
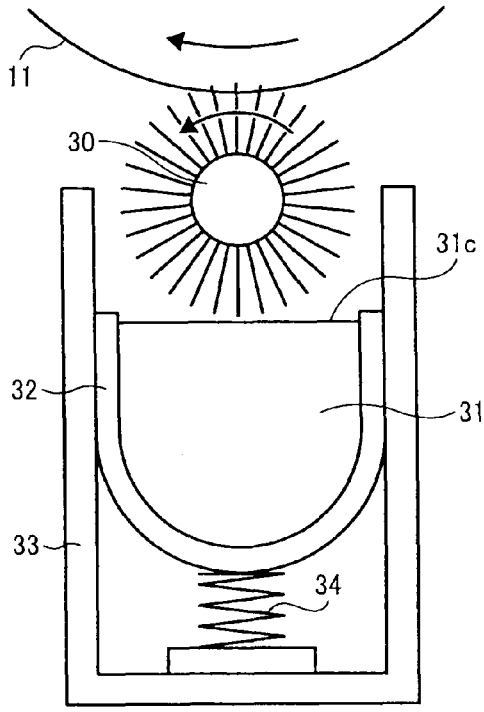
FIG. 14 is a cross-sectional view of a brush roller and the lubricant holder of FIG. 9.

FIG. 14 illustrates a cross-sectional view of the brush roller 30 and the lubricant holder 32, viewed from one end portion thereof.

As shown in FIG. 14, the pressing member 34 is pressed against the lubricant holder 32 so that the upper face 31*c* of the solid lubricant 31 and the brush roller can contact with each other. With this configuration, as the brush roller 30 rotates with the photoconductor 11 in a forward direction or a direction of rotation of the photoconductor 11, the solid lubricant 31 contacting the brush roller 30 is slidably scraped by the brush roller 30 into powder lubricant. The powder lubricant scraped by the brush roller 30 adheres to the brush fibers of the brush roller 30 so as to be supplied to the surface of the photoconductor 11.

Figure 15:
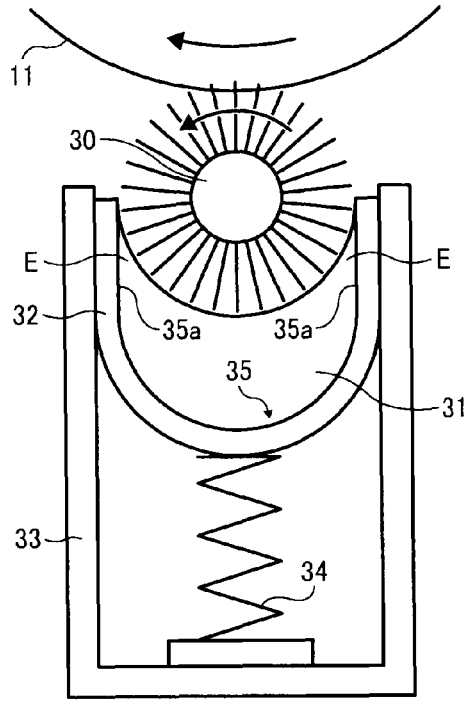
FIG. 15 is a cross-sectional view of the brush roller and the lubricant holder, showing a consequent step from FIG. 14.

FIG. 15 illustrates a cross-sectional view of the brush roller 30 and the lubricant holder 32, showing a next step from FIG. 14. As shown in FIG. 15, the solid lubricant 31 is scraped by the brush roller 30, as the upper face 31*c* of the solid lubricant 31 is consumed it acquires an arc-shaped recess. Even the thickness of the solid lubricant 31 is gradually reduced with time, since the solid lubricant 31 itself is pressed by the pressing member 34 toward the brush roller 30, the solid lubricant 31 can contact the brush roller 30 constantly.

Further, the solid lubricant 31 of FIG. 15 has edge portions E that sharply protrude at both ends of the cross-section of the solid lubricant 31. The edge portions E of the solid lubricant 31 are supported by the side faces 35*a* of the recessed portion 35 of the lubricant holder 32.

Figure 16:
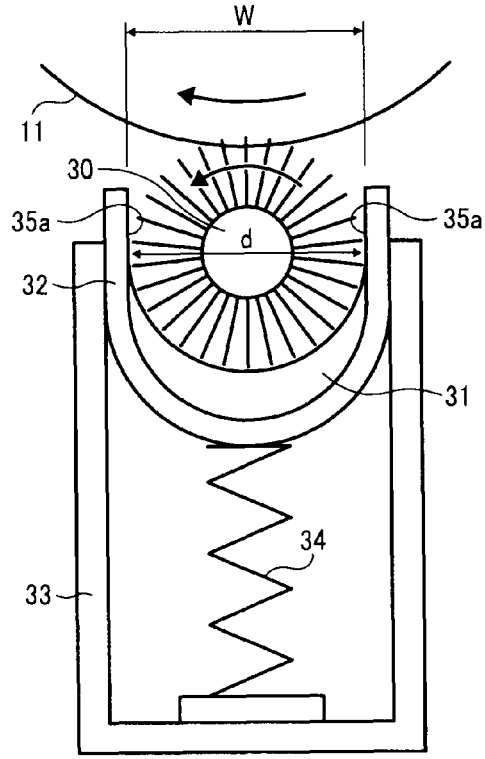
FIG. 16 is a cross-sectional view of the brush roller and the lubricant holder, showing a consequent step of FIG. 15.

FIG. 16 illustrates a cross-sectional view of the brush roller 30 and the lubricant holder 32, showing a next step from FIG. 15. As shown in FIG. 16, as the brush roller 30 further scrapes and wears the solid lubricant 31, the brush roller 30 comes more into the recessed portion 35 of the lubricant holder 32. At this time the width W of the recessed portion 35 is substantially equal to the outer diameter "d" of the brush roller 30. This configuration can prevent the brush fibers of the brush roller 30 from interfering with the inner faces (i.e., the side faces 35*a*) of the recessed portion 35 to collapse. Therefore, a degradation of lubricant supplying performance due to collapse of the brush fibers of the brush roller 30 can be prevented, so that the lubricant can be supply to the photoconductor 11 stably. Further, when a different rotary lubricant supplying member such as a sponge roller and a non-woven fabric roller is employed as an alternative rotary lubricant supplying member to the brush roller 30, the lubricant supplying member cannot interfere firmly with the side faces 35*a* of the recessed portion 35 of the lubricant holder 32, thereby maintaining the constant lubricant supplying performance.

When the width W of the recessed portion 35 is set to be greater than the outer diameter "d" of the brush roller 30, the collapse of the brush roller 30 can be prevented. However, it is not preferable because a larger amount of the solid lubricant 31 can remain unused.

Figure 17:
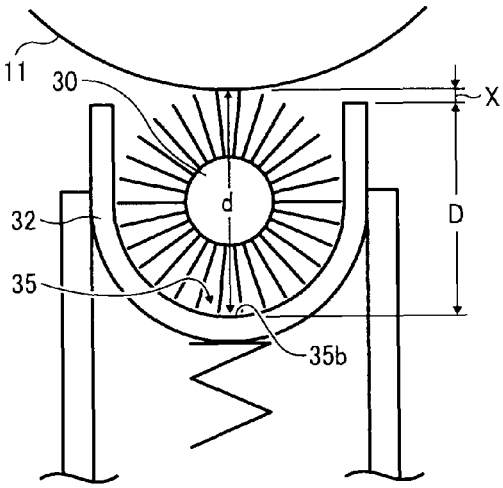
FIG. 17 is a cross-sectional view of the brush roller and the lubricant holder, showing a consequent step of FIG. 16.

FIG. 17 illustrates a cross-sectional view of the brush roller 30 and the lubricant holder 32, showing a step following the view of FIG. 16. As shown in FIG. 17, the brush roller 30 has scraped the entire solid lubricant 31 and the brush roller 30 has contacted the bottom face 35*b* of the recessed portion 35 of the lubricant holder 32. The lubricant holder 32 shown in FIG. 17 includes the bottom face 35*b* of the recessed portion 35 in a semi-arc-shaped recess that has a substantially same radius as the radius of the brush roller 30. Therefore, as compared with a lubricant holder such as the lubricant holder 232 having the flat bottom face 235*b* of the recessed portion 235 as shown in FIG. 18, the lubricant holder 32 having the round bottom face 35*b* shown in FIG. 17 can consume the solid lubricant 31 effectively without leaving the solid lubricant 31 remained therein.

Figure 18:
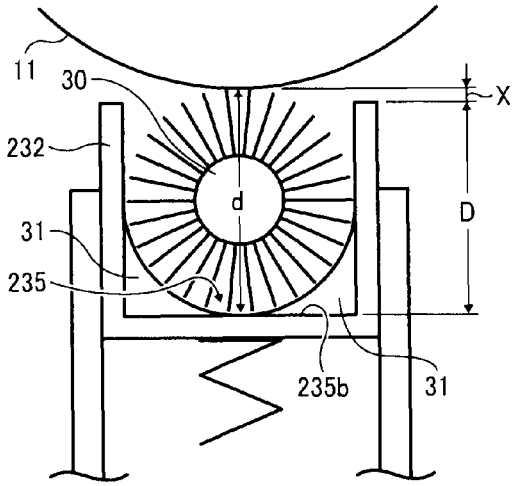
FIG. 18 is a cross-sectional view of the brush roller and the lubricant holder of FIG. 11, viewed from one end portion of the lubricant supplying unit of FIG. 6.

Further, as shown in FIGS. 17 and 18, the depth D of the recessed portion 35 is smaller than the outer diameter "d" of the brush roller 30. Therefore, only a part of the brush roller 30 projects from the opening 35*c* of the lubricant holder 32 by a distance X. Even after the solid lubricant 31 has been completely consumed, the brush roller 30 projecting from the opening 32*a* of the lubricant holder 32 can still maintain the distance X between the lubricant holder 32 and the photoconductor 11. The above-described configuration can prevent the lubricant holder 32 to contact the surface of the photoconductor 11, which can prevent the lubricant holder 32 from contacting and damaging the photoconductor 11.

When using the solid lubricant 31 in which the shape of the upper face 31*c* is formed to an arc-shaped recess in advance as shown in FIG. 10, a constant area of a cut face of the solid lubricant 31 can be maintained from the beginning to the end of use of the solid lubricant 31, thereby supplying lubricant more stably.

Figure 19:
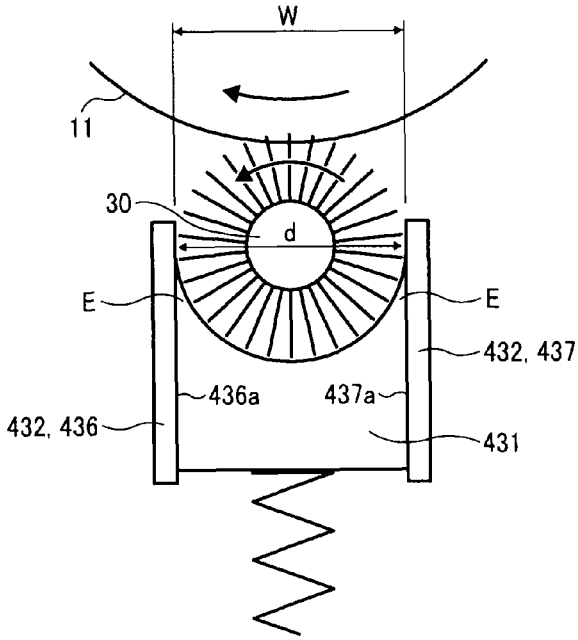
FIG. 19 is a cross-sectional view of the brush roller and the lubricant holder of FIG. 13, viewed from one end portion of the lubricant supplying unit of FIG. 6.

Next, a description is given of working and effects of the lubricant supplying unit 3 shown in FIG. 13 according to the present invention, in reference to FIG. 19.

FIG. 19 illustrates a cross-sectional view of the brush roller 30 and the lubricant holder 432, viewed from one end portion thereof.

As shown in FIG. 19, as the brush roller 30 rotates with the photoconductor 11 in a forward direction or a direction of rotation of the photoconductor 11, the solid lubricant 431 contacting the brush roller 30 is slidably scraped by the brush roller 30 into powder lubricant, which is similar to the solid lubricant 431 shown in FIG. 15. As the solid lubricant 431 is scraped by the brush roller 30, as the upper face 431*c* of the solid lubricant 431 is consumed it acquires an arc-shaped recess. Edge portions E that sharply project at both ends of the cross-section of the solid lubricant 431. The edge portions E of the solid lubricant 431 shown in FIG. 19 are supported by the inner faces 436*a* and 437*a* of the planar members 436 and 437 of the lubricant holder 432.

Further, the width W between the pair of planar members 436 and 437 is substantially equal to the outer diameter "d" of the brush roller 30. Therefore, as the above-described exemplary embodiment, the brush fibers of the brush roller 30 according to this exemplary embodiment of the present invention cannot interfere with the inner faces 436*a* and 437*a* of the planar members 436 and 437, thereby not causing the collapse of the brush fibers of the brush roller 30. Accordingly, the brush roller 30 can maintain the constant lubricant supplying performance and can supply an even amount of lubricant effectively.

As described above, the lubricant supplying unit 3 of the present invention includes the lubricant holder 32 that supports the sharply projected edge portions E formed in the cutting process of the solid lubricant 31, and therefore the edge portions E can be maintained. With this configuration, occurrence of defective images caused by broken-off pieces of the solid lubricant 31 entering into the process units or other image forming components can be prevented, and as a result, a lubricant supplying unit (i.e., the lubricant supplying unit 3), a highly reliable process unit (i.e., the process unit 10) that incorporates the lubricant supplying unit, and an image forming apparatus (i.e., the image forming apparatus 1) that incorporates the lubricant supplying unit can be provided.

Further, the solid lubricant 31 is supported by the lubricant holder 32. Therefore, a user can replace the solid lubricant 31 without touching it directly.

Further, the lubricant holder 32 protects the solid lubricant 31 by holding the solid lubricant 31 therein. Therefore, the durability of the solid lubricant 31 from external impact can be enhanced.

Thus, according to the present invention, contamination and damage to the solid lubricant 31 in handling the solid lubricant 31 can be reduced.

While the above-described exemplary embodiments have been shown and described, various modifications and substitutions may be made thereto without departing from the spirit and scope of the present invention. Accordingly, it is to be understood that the present invention has been described by way of illustrations and not limitation. For example, the present invention can be applicable to a unit to supply lubricant to an intermediate transfer member such as an intermediate transfer belt that serves as an image carrier. Further, the lubricant supplying unit according to the present invention is not limited to be incorporated in an image forming apparatus employing an intermediate transfer system but is also applicable to an image forming apparatus employing a direct transfer system or any other transfer system.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A lubricant supplying unit, comprising:

a rotary lubricant supplying member to contact a surface of an image carrier to rotate with the image carrier;

a lubricant;

a lubricant holder to hold the lubricant; and a pressing member to press the lubricant toward the rotary lubricant supplying member either directly or via an intermediate transfer member, the rotary lubricant supplying member rotating to scrape the lubricant to supply the scraped lubricant to the image carrier, wherein the lubricant holder comprises an opening facing the rotary lubricant supplying member and a recessed portion defined by side faces facing each other and a bottom face having an arc-shaped recess to accommodate the lubricant therewithin, and wherein the side faces of the recessed portion of the lubricant holder support at least the entire side face of the lubricant in the cross-section of the lubricant and the lubricant holder in a direction perpendicular to the axial direction of the rotary lubricant supplying member.

2. The lubricant supplying unit according to claim 1, wherein a width between the side faces of the recessed portion of the lubricant holder is substantially equal to a diameter of the rotary lubricant supplying member in the cross-section of the lubricant and the lubricant holder in a direction perpendicular to the axial direction of the rotary lubricant supplying member.

3. The lubricant supplying unit according to claim 1, wherein a radius of the bottom face of the recessed portion of the lubricant holder has an arc-shaped recess substantially equal to a radius of the rotary lubricant supplying member and the bottom face of the lubricant has an arc-shaped projection to fit the bottom face of the recessed portion of the lubricant holder in the cross-section of the lubricant and the lubricant holder in a direction perpendicular to the axial direction of the rotary lubricant supplying member.

4. The lubricant supplying unit according to claim 1, wherein a depth of the recessed portion of the lubricant holder is smaller than an outer diameter of the rotary lubricant supplying member.

5. The lubricant supplying unit according to claim 1, wherein the lubricant is formed by injecting melted lubricant in the recessed portion of the lubricant holder, and solidifying the injected lubricant in the lubricant supplying unit.

6. The lubricant supplying unit according to claim 5, wherein the lubricant holder is formed as a heat-resistant member.

7. The lubricant supplying unit according to claim 6, wherein the heat-resisting member is capable of withstanding temperatures of 140 degrees Celsius or greater.

8. The lubricant supplying unit according to claim 1, wherein the opposed face of the lubricant disposed opposite the rotary lubricant supplying member has an arc-shaped recess having a radius substantially equal to a radius of the rotary lubricant supplying member in the cross-section of the lubricant in a direction perpendicular to the axial direction of the rotary lubricant supplying member.

9. The lubricant supplying unit according to claim 8, wherein the lubricant is formed in an arc-shaped recess by using a molding member.

10. The lubricant supplying unit according to claim 1, wherein the lubricant holder is detachably attachable to the lubricant supplying unit.

11. The lubricant supplying unit according to claim 1, integrally mounted with an image carrier to carry a latent image on a surface thereof, the lubricant supplying unit and the image carrier disposed within a process unit removably installable in an image forming apparatus.

12. An image forming apparatus, comprising:

an image carrier to carry an electrostatic latent image on a surface thereof;

a charging unit disposed facing the image carrier to uniformly charge the surface of the image carrier;

an exposure unit to expose the surface of the image carrier to form the electrostatic latent image;

a developing unit to supply toner to the electrostatic latent image formed on the surface of the image carrier to develop the electrostatic latent image into a visible image;

a transfer unit to transfer the visible image formed on the surface of the image carrier onto a recording medium directly or via an image transfer member;

a cleaning unit to remove residual toner remaining on the surface of the image carrier; and the lubricant supplying unit according to claim 1.

13. A method of manufacturing the lubricant supplying unit according to claim 1, the method comprising:

melting the lubricant;

injecting the lubricant into the recessed portion of the lubricant holder; and solidifying the injected lubricant in the lubricant supplying unit.

14. The method of manufacturing the lubricant supplying unit according to claim 13, further comprising forming the lubricant holder as a heat-resistant member.

15. The method of manufacturing the lubricant supplying unit according to claim 14, wherein the heat-resistant member is capable of withstanding temperatures of 140 degrees Celsius or greater.

* * * * *